US005415507A

United States Patent [19]

Janusz et al.

[11] Patent Number: 5,415,507

[45] Date of Patent: May 16, 1995

[54] ANCHOR WITH ADJUSTABLE SEAL

[75] Inventors: Michael Janusz, Elgin; Patrick M. Monahan, Rockton, both of Ill.

[73] Assignee: Elco Industries, Inc., Rockford, Ill.

[21] Appl. No.: 99,191

[22] Filed: Jul. 29, 1993

[51] Int. Cl.[6] ..... F16B 31/00

[52] U.S. Cl. ..... 411/5; 411/383; 411/387

[58] Field of Search ..... 411/1, 2, 3, 4, 5, 383, 411/387, 82

[56] References Cited

U.S. PATENT DOCUMENTS

| | | | |
|---|---|---|---|
| 2,546,602 | 3/1951 | Keating . | |
| 3,188,815 | 6/1965 | Schuermann et al. . | |
| 3,244,055 | 4/1966 | Schuermann et al. . | |
| 4,034,641 | 7/1977 | Williams, Jr. et al. | 411/387 |
| 4,477,209 | 10/1984 | Hipkins, Jr. et al. | 411/5 X |
| 4,564,324 | 1/1986 | Leibhard | 411/3 |
| 4,678,374 | 7/1987 | Calandra, Jr. | 411/2 X |
| 4,679,966 | 7/1987 | Yacisin | 411/2 X |
| 4,772,166 | 9/1988 | Shamah et al. | 411/32 |
| 4,865,489 | 9/1989 | Stankus | 411/82 X |
| 4,883,396 | 11/1989 | Shamah et al. | 411/55 |
| 5,018,920 | 5/1991 | Speakman | 411/43 |
| 5,030,052 | 7/1991 | Anderson et al. | 411/383 |
| 5,059,073 | 10/1991 | Revol et al. | 411/82 X |
| 5,104,266 | 4/1992 | Daryoush et al. | 411/82 X |
| 5,232,322 | 8/1993 | Regensburger | 411/387 |

*Primary Examiner*—Rodney M. Lindsey
*Attorney, Agent, or Firm*—Leydig, Voit & Mayer, Ltd.

[57] ABSTRACT

A fastener assembly for anchoring masonry to a wall support stud includes a sealing member releasably seated in a retaining groove. The fastener threads into the support stud and is affixed to a hole in the masonry with a bonding agent. The retaining groove holds the sealing member in place during the installation of the fastener, and a break-off groove enables the fastener to be severed inside the masonry. After the fastener has been severed, the sealing member can be relocated inside the masonry to a pre-determined sealing position, thereby insuring the use of a controlled volume of bonding agent.

5 Claims, 2 Drawing Sheets

ANCHOR WITH ADJUSTABLE SEAL

BACKGROUND OF THE INVENTION

The present invention relates to fasteners for attaching masonry walls to stud supports in buildings and other structures. More particularly, the invention provides a fastener which has one end that threads into a wall stud and an opposite end which is anchored to the masonry wall by means of a bonding agent. While the fastener of the invention may be used in various situations, it is most commonly used with structures which require additional stabilization or reinforcement, either due to insufficient reinforcement during initial construction or for seismic reinforcement.

To extend the useful life of a masonry wall, it is commonly anchored to a studded non-masonry wall for support. In order to provide both a moisture barrier between the walls and increase the thermal insulation of the building, the masonry wall is usually separated from the studded wall by an air gap. The width of the air gap typically varies from building to building and, often in older buildings, the air gap width increases due to age and stress.

Conventional fasteners used to anchor masonry walls pass through a bored hole in the masonry wall and traverse the air gap, to either screw into a hole in the stud, or to attach to a bored hole in the stud with an expansion plug. The fasteners are then anchored to the bored hole in the masonry wall with either another expansion plug or with epoxy resin.

Fasteners utilizing expansion plugs are relatively expensive and often result in weak non-uniform anchors. In addition, expansion plugs do not provide water tight seals, thereby requiring additional steps to seal exposed plugs or requiring the installation an O-ring around the fastener and in the air gap to prevent moisture from traveling along the fastener to the internal wall. Somewhat more conventional fasteners of the type disclosed in Anderson U.S. Pat. No. 5,030,052 can be anchored to the masonry wall with a bonding agent, but require numerous time consuming operations and are not readily adapted to variations in air gap width.

SUMMARY OF THE INVENTION

The general aim of the present invention is to provide a fastener of the above general type having a means of retaining a controlled volume of bonding agent around the fastener in the masonry wall in a simpler and less expensive manner then prior fasteners.

A more detailed object of the invention is to achieve the foregoing by retaining a sealing member in a groove in the fastener such that, following the initial steps of installing the fastener, the sealing member may be repositioned in the masonry wall and the fastener may be anchored in place with the bonding agent. The sealing member insures the retention of a controlled volume of bonding agent, and the retaining groove eliminates the need for installing the sealing member after the fastener has been anchored to the stud.

The invention also resides in the provision of an inexpensive threaded rod which can be easily modified to adapt the fastener for variations in width of the air gap. In another aspect, the invention involves a unique method of installing the fastener.

These and other objects and advantages of the invention will become more apparent from the following detailed description when taken in conjunction with the accompanying drawings.

DETAILED DESCRIPTION OF THE PREFERRED EMBODIMENTS

Figure 1:
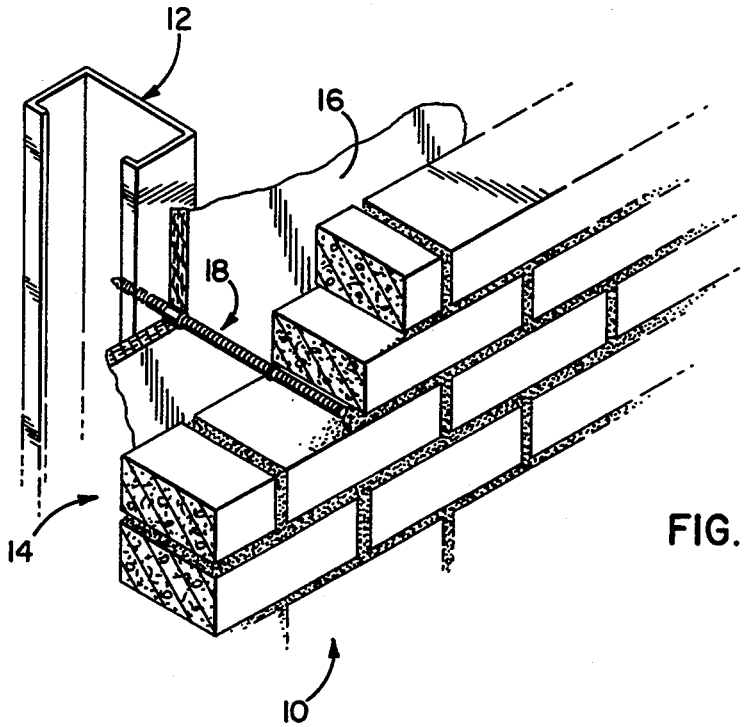
FIG. 1 is a cutaway perspective view of an exterior masonry wall anchored with a new and improved fastener incorporating the unique features of the present invention, certain components being broken away and shown in section.

For purposes of illustration, the invention has been shown in the drawings in conjunction with an exterior masonry wall 10 adapted to be anchored to an interior metal wall stud 12. The masonry wall typically is separated from the stud by an intermediate air gap 14 and by sheathing or other insulating material 16.

Figure 2:
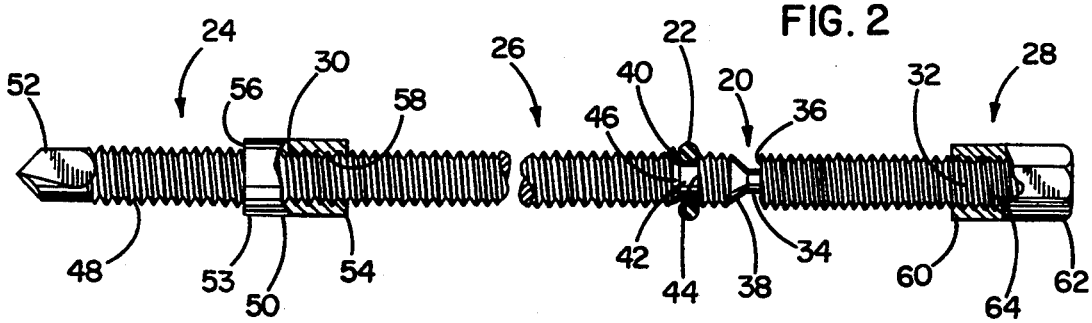
FIG. 2 is a side view of the fastener with certain components being broken away and shown in section.

In accordance with the present invention, the masonry wall 10 is anchored to the support stud 12 by a unique fastener 18 (FIG. 1). One feature of the fastener is a break-off groove 20 (FIG. 2) which enables the fastener 18 to sever inside the masonry wall 10 when the fastener properly engages the stud 12. An important element of the fastener is a sealing member 22 releasably seated on the fastener and adapted to be easily relocated on the fastener during installation thereby eliminating time-consuming operations. By virtue of retaining the sealing member on the fastener during initial installation, the member can be precisely relocated to insure a controlled amount of bonding agent is retained to anchor the fastener to the masonry.

More specifically, the fastener 18 comprises a self-drilling, self-tapping screw 24, a threaded rod 26, a driving head 28 and the sealing member 22. The threaded rod includes an anchor end 30 and an opposite facing driving end 32. The break-off groove 20 is formed around the rod near the driving end 32 and has a substantially flat bottom 34 having first and second end portions 36, 38. The first end portion 36, located in proximity to the driving end 32, is perpendicular to the axis of the rod. The second end portion 38 flares outwardly upon progressing axially toward the anchor end 30 of the rod. Axially located between the break-off groove 20 and the anchor end 30 is an annular retaining groove 40. The depth of the retaining groove is less than the depth of the break-off groove. The retaining groove has a substantially flat bottom 42 having first and second end portions 44, 46. The first end portion 44, located in proximity to the break-off groove, is perpendicular to the axis of the rod. The second end 46 flares outwardly upon progressing axially toward the anchor end 30 of the rod.

The screw 24 includes an elongated threaded shank 48 with an enlarged head 50 formed on one end and a drilling tip 52 on the other. The cylindrically-shaped screw head 50 has first and second end portions 53, 54. First end portion 53 is integral with the shank 48 and forms a shoulder 56 around the threaded shank. Second end portion 54 is substantially flat and has a threaded axial bore 58 extending partially through the head and toward the threaded shank so as to threadingly receive the anchor end 30 of the rod 26. As an alternative, an internally threaded sleeve (not shown) may serve as a coupling between the rod 26 and a self-drilling, self-tapping screw without a head such as the head 50.

The driving head 28 is preferably but not necessarily hexagonal and has two opposite facing end portions 60, 62. The end portion 60 is substantially flat and is formed with a threaded axial bore 64 extending partially through the driving head toward the opposite end portion 62 so as to threadingly receive the driving end 32 of the rod 26.

Figure 7:
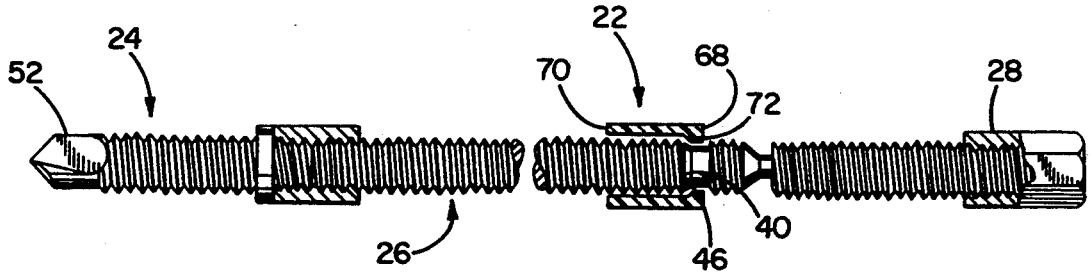
FIG. 7 is a view similar to FIG. 2 but shows another version of the fastener.
Figure 3:
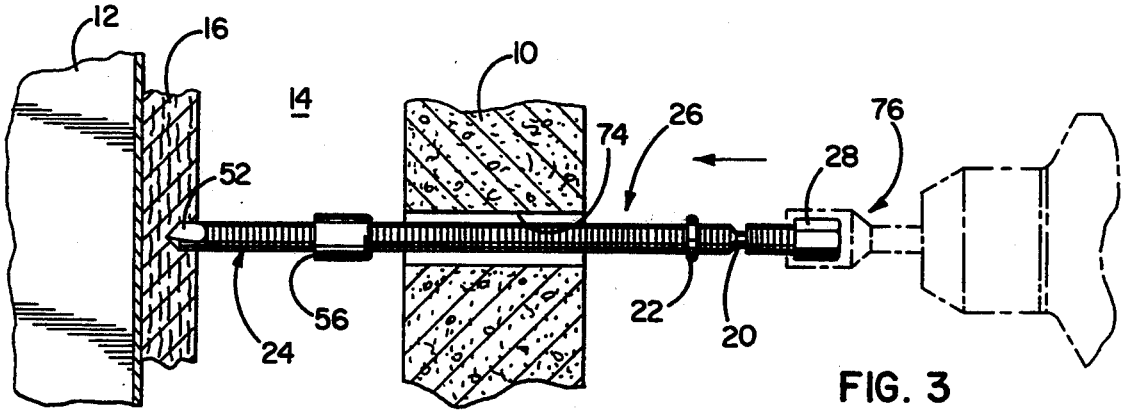
FIGS. 3–6 are generally cross-sectional views showing successive steps of installing the fastener.

The sealing member 22 releasably seats in the retaining groove 40 and is preferably a rubber O-ring. In an alternative embodiment (FIG. 7), the sealing member 22 is a plastic sleeve with first and second ends 68, 70. The inside diameter of the sleeve is larger than the diameter of the rod 26. The inside diameter at the first end 68 has a radial shoulder 72 protruding inwardly and releasably seats in the retaining groove. The shoulder 72 tapers at one end as it progresses toward the second end of the sleeve.

In the assembled fastener, the anchor end 30 of the rod 26 is threaded into the screw bore 58, and the sealing member 22 is installed over the rod such that it releasably seats in the retaining groove 40. The flared end portion 38 of the break-off groove 20 enables the sealing member to be installed on the rod from the driving end 32 without permanently seating in the break-off groove. In the alternative embodiment (FIG. 7), the plastic sleeve 22 is installed over the rod so that the open end 70 is positioned toward the screw 24 and the shoulder 72 releasably seats in the retaining groove. The driving head bore 64 threadingly receives the driving end 32 of the rod.

FIGS. 3 through 6 illustrate the installation of the fastener 26 to the masonry wall 10 and the support stud 12. In the initial step, a hole 74 is bored through the masonry such that it is substantially perpendicular to and is aligned with the stud. The fastener is inserted in the masonry bore and a torquing device 76 (e.g., a power-driven socket) is fitted over the driving head 28. The torquing device rotates the fastener at speeds up to 2500 r.p.m. so that the drilling tip 52 of the screw bores a hole through the insulation, sheathing or other intermediate material (not shown), and into the stud. During the torquing process, the retaining groove 40 keeps the sealing member 22 from moving along the threaded rod 26. Also, the sealing member 22 tends to stabilize the rod 26 to help keep the rod centered in the bore 74.

Figure 4:
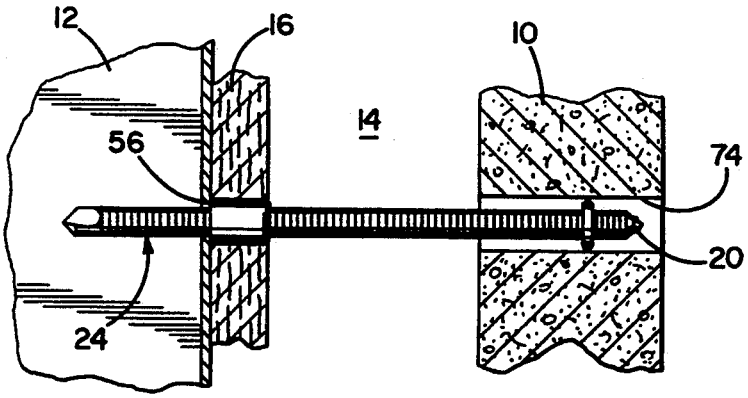

Referring to FIG. 4, the screw 24 is threaded into the stud until the shoulder 56 of the screw is seated against the stud. Thereafter, when the torque applied to the driving head 28 by the torquing device 76 exceeds a predetermined magnitude, the driving head and that portion of the rod 26 that is screwed into the head are separated from the remainder of the rod in the vicinity of the break-off groove 20. The depth of the break-off groove is greater than the depth of the retaining groove 40 to insure that the rod is severed at the break-off groove and not at the retaining groove. To adapt the fastener 18 to variations in either the width of the air gap 14 or thickness of the masonry wall 10, the length of the rod 26 between the break-off groove and the anchor end 30 can be shortened by cutting the rod.

Figure 5:
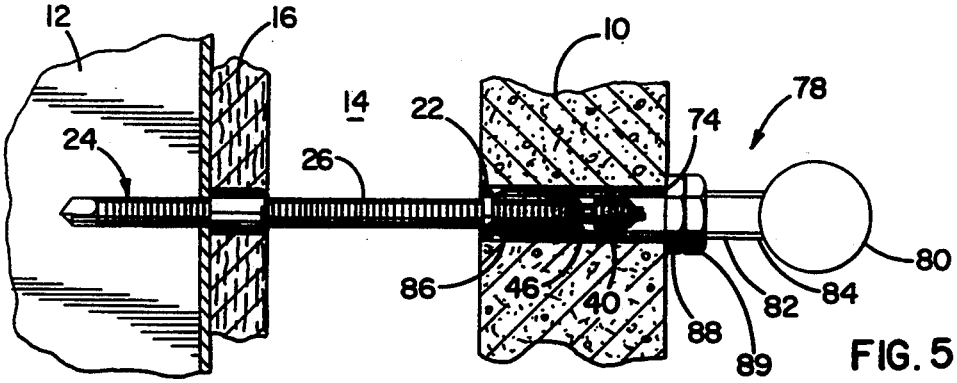
Figure 6:
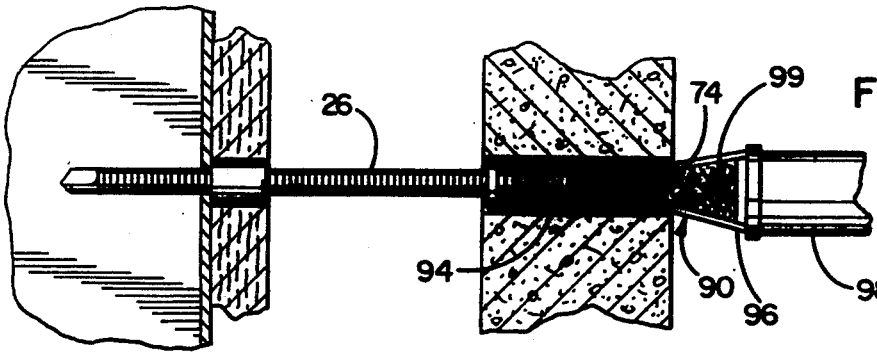

Referring to FIG. 5, a mandrel 78 having a handle 80 and an externally threaded tubular shaft 82 is used to relocate the sealing member 22. The tubular shaft includes two oppositely facing ends 84, 86, one end 84 being attached to the handle. The outside diameter of the shaft is less than the diameter of the masonry bore 74, so that the mandrel can freely slide inside the bore. The inside diameter of the shaft is larger than the diameter of the rod 26, so that the shaft can freely slide over the rod. Two standard opposing hexagonal nuts 88, 89 are threaded over the shaft.

After the driving head 28 has been separated, the mandrel 78 is inserted in the bore 74, over the rod 26 and into engagement with the sealing member 22. The tapered side 46 of the retaining groove 40 allows the sealing member 22 to release and relocate axially down the rod toward the screw 24 when an axial force is applied to the sealing member by the mandrel. The sealing member is pushed along the rod by the mandrel a predetermined distance established by the location of the nut 88.

When the nut 88 of the mandrel 78 seats against the exterior masonry surface, the sealing member 22 is at its final position on the rod 26 and is located just short of the end of the bore 74. After the mandrel 78 has been removed from the bore 74, an injection nozzle 90 (FIG. 6) is inserted in the bore. The nozzle is substantially tubular and includes first and second end portions 94, 96. The first end portion 94 has an outside diameter less than the diameter of the bore so that the nozzle can freely slide inside the bore, and an inside diameter larger than the diameter of the rod 26 so that the nozzle can freely slide over the rod. The second end portion 96 flares outwardly to a diameter larger than the bore and attaches to an injection tube 98. The flared portion 96 prevents the first end portion 94 from contacting the sealing member 22. A bonding agent 99 is pumped through the nozzle and into the bore around the rod. The sealing member fitting snugly on the rod, and against the bore, so as not to form an airtight seal, thereby retaining the bonding agent inside the bore, while allowing gases to escape into the air gap.

In some instances, the radial clearance between the rod 26 and the bore 74 may not be sufficient to enable the nozzle 90 to telescope over the rod. In such a case, a relatively short nozzle is simply inserted a short distance into the end of the bore to inject the bonding agent.

From the foregoing, it will be apparent that the present invention brings to the art a fastener 18 with a retaining groove 40 which holds a sealing member 22 in place during driving of the fastener and which thereafter releases the sealing member for repositioning along the rod 26. The sealing member, with a snug slidable fit over the rod, insures that a controlled volume of bonding agent is injected into the masonry bore. The sealing member is pre-installed on the fastener, thereby reducing the cost of installing and positioning the member.

We claim:

1. A fastener comprising a self-drilling and self-tapping screw, an elongated threaded rod having first and second end portions, said first end portion of said rod being threadably connected to said screw, a driving head threadably connected to said second end portion of said rod, first and second axially spaced grooves formed around said rod between said screw and said head, said first groove being located between said second groove and said head and being of greater depth than said second groove whereby said rod fractures in the vicinity of said first groove and causes said head to separate from said rod when torque of predetermined magnitude is applied to said fastener, and an annular sealing member releasably seated in said second groove and capable of moving axially out of said second groove and along said rod toward said screw when an axial force of predetermined magnitude is applied to said sealing member.

2. A fastener as described in claim 1 in which said second groove has one end which flares outwardly upon progressing axially toward said screw so as to facilitate axial movement of said sealing member out of said groove.

3. A fastener as described in claim 2 in which said first groove has one end which flares outwardly upon progressing axially toward said screw.

4. A fastener as described in claim 1 in which said sealing member is an O-ring.

5. A fastener as described in claim 1 in which said sealing member is a plastic sleeve with one end portion having a radially inwardly extending shoulder releasably seated in said second groove.

* * * * *